United States Patent [19]

Katva

[11] Patent Number: 4,609,130

[45] Date of Patent: Sep. 2, 1986

[54] ARRANGEMENT IN LIQUID DISPENSERS

[75] Inventor: Ilmari Katva, Odense, Denmark

[73] Assignee: Plum Kemi Produktion A/S, Assens, Denmark

[21] Appl. No.: 642,069

[22] Filed: Aug. 17, 1984

[30] Foreign Application Priority Data

Aug. 19, 1983 [SE] Sweden ..... 8304514

[51] Int. Cl.[4] ..... B65D 37/00

[52] U.S. Cl. ..... 222/207; 222/214

[58] Field of Search ..... 222/207, 209, 214, 181, 222/321; 417/479, 480

[56] References Cited

U.S. PATENT DOCUMENTS

| | | | |
|---|---|---|---|
| 3,726,442 | 4/1973 | Davidson et al. | 222/207 |
| 3,995,774 | 12/1976 | Cooprider et al. | 222/207 |
| 4,088,248 | 5/1978 | Blake | 222/207 |
| 4,347,953 | 9/1982 | Bauer | 222/207 |
| 4,394,938 | 7/1983 | Frassavito | 222/207 |

FOREIGN PATENT DOCUMENTS

| | | | |
|---|---|---|---|
| 3101020 | 12/1981 | Fed. Rep. of Germany | 222/207 |
| 2144652 | 2/1973 | France . | |
| 2520702 | 8/1983 | France . | |

*Primary Examiner*—H. Grant Skaggs

*Attorney, Agent, or Firm*—Nils H. Ljungman

[57] ABSTRACT

The invention relates to a diaphragm pump for dispensing or metering purposes, for example for use in liquid soap dispensers. The pressure chamber (7) of the pump is defined by a fixed wall (6) and the diaphragm (1). A check-valve on the inlet side towards a storage vessel (11) forms a cylindrical flange (4) movable in a groove (5) and sealing against the outer surface thereof. Arranged in a spout (2) passing through the diaphragm is an oblique wall (3), which is slotted through a short distance around its periphery, thereby to form a seal against the suction of air into the pressure chamber (7). The diaphragm (1) is arranged to be compressed by a pressure body (9) provided on a lever (8).

20 Claims, 1 Drawing Figure

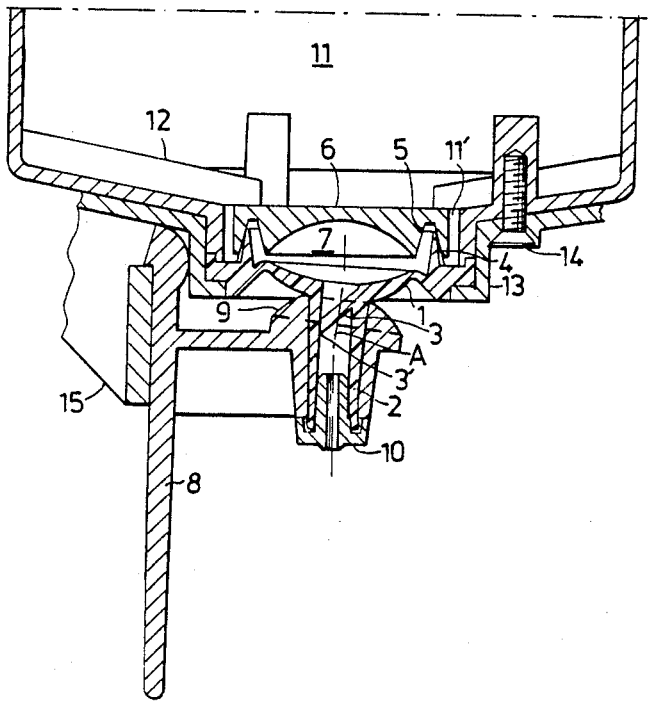
11
12
6
5
11'
7
4
14
13
9
1
3
A
3'
2
15
10
8

ARRANGEMENT IN LIQUID DISPENSERS

The present invention relates to a diaphragm pump for liquid dispensers, such as liquid soap dispensers, of the kind intended to be positioned beneath a liquid-storage vessel connected to the pump, and to be operated manually by means of a pull-lever, which acts upon the pump diaphragm to discharge a given quantity of liquid.

Liquid dispensers of the kind which are intended to be located beneath the liquid-storage vessel are encumbered with a particular drawback, namely that the check valve or valves of the pump tend to lose their sealing efficiency. This drawback is particularly manifest in the case of liquid soap dispensers, i.e. dispensers which meter a given quantity of liquid soap. Because of the low surface tension of the soap solution, it is readily able to penetrate through gaps and cracks present, for example, between the elastomeric lips of a check valve and the lip seatings. Such dispensers are mass produced, normally from injection-moulded, plastics components. Although these components are produced with good dimensional accuracy, the build-up of soap deposits in use greatly impairs the sealing function of the check-valves.

One type of pump for the aforesaid purpose has a hose-like diaphragm valve, which, when effecting a dispensing operation, is compressed by a pressure plate mounted on an operating lever. The hollow interior of the hose forms the pressure chamber, and both the inlet and outlet of the chamber comprise downwardly-directed cup-like members provided with slots at the ends thereof. The sealing function of the check valve is satisfactory when the hose-like diaphragm is compressed, but when the diaphragm is relaxed the inherent or natural tensions in the material are unable to hold the sides of the slots pressed together in a manner to provide an efficient seal and to prevent the soap solution from leaking out.

Pumps provided with warted diaphragms are also used in the present context. Although the sealing function of the check-valve of such pumps is satisfactory when the diaphragm is compressed, the natural or inherent tensions in the material are unable to hold the valve flaps hard against their seats to provide an effective seal, and hence the soap solution again leaks through the valve.

The object of the present invention is to provide a diaphragm pump which does not rely upon a check-valve sealing function, thereby to avoid the drawbacks associated with known dispensing or metering apparatus of the aforementioned kind. A further object of the invention is to provide a liquid dispenser in which the liquid to be metered or dispensed obtains a liquid-centering flow path in the pump, thereby to avoid the formation of deposits on the check-valve seats.

These objects are achieved by means of the invention, having the characterizing features disclosed in the following claims. The significance of these characterizing features will be explained hereinafter.

The diaphragm pump is located beneath and disposed as a bottom extension of the storage vessel of the dispensing or metering apparatus includes a pressure chamber having a cup-shaped cavity and an upper solid wall. Arranged in the wall is an annular groove which, together with a resilient, ring-shaped flange arranged therein, forms the check-valve of the pump on the suction side thereof.

The flange is formed integrally with the pump diaphragm, which forms the lower wall of the pressure chamber. The liquid to be dispensed has access to the outer surface of the flange and acts upon the flange at a given hydrostatic pressure. This pressure corresponds to the natural tension in the flange. In order to increase the counter-pressure exerted by the flange, the outer diameter of the flange can be made larger than the outer diameter in the ring-shaped groove. Thus, when the pump is assembled the flange is compressed and biased so as to abut on the outer surface of the ring-shaped groove at considerable pressure.

Extending through the suitably downwardly cupped part of the diaphragm is an outlet pipe. This is preferably formed integrally with the diaphragm and includes an obliquely positioned wall. The wall is firmly joined with the pipe, with the exception of a short distance around its periphery, where a slot-like outlet opening is arranged for the dispensed fluid.

To enable the diaphragm to be compressed inwardly of the pressure chamber, the pump is provided with a lever which is journalled on a pivot arm and provided with a suitable pressure body. This pressure body constantly lies against the diaphragm in its relaxed, resting position. Means are also provided for mounting the pump securely beneath and in fluid communication with the storage vessel of the dispenser.

A preferred embodiment of the invention will now be described in more detail with reference to the accompanying drawing, which is a fragmentary vertical sectional view of a dispensing apparatus.

A diaphragm pump intended for dispensing or metering purposes includes an elastic diaphragm 1 having a cup-shaped cavity or a central portion. Extending from the centre of the cup-shaped portion is a discharge spout 2. Obliquely arranged in the spout 2, so as to form an acute angle with the centre line (A) of said spout is a wall 3. The wall 3 is firmly connected to the inner wall surface of the spout 2, with the exception of a short distance around the periphery of a certain wall 3. At the location, there is no continuity between the wall 3 and the spout wall, and, at that location there is provided a slot 3'.

Because the centre line of the spout 2 is slightly S-shaped downwardly towards the side where the slot 3' is located, the force holding the slot closed is amplified. The effect produced thereby will be explained in more detail hereinafter.

Arranged on the side of the diaphragm 1 opposite the spout 2 is a cylindrical flange 4 which may be annular, which is formed integrally with the diaphragm. The flange 4 is accommodated in a groove 5 formed in a wall 6, which together with the diaphragm 1 forms the pressure chamber 7 of the pump.

The flange 4 has an original outer diameter which is greater than the outer diameter of the groove 5, but when the pump is assembled the flange becomes compressed and thereby sealingly abuts the outer surface of the groove 5. This constitutes an advantageous feature in the functioning of the pump, as hereinafter described.

The pump is operated by pulling a lever 8 supported to be journalled on the attachment 15 of the dispensing apparatus. Mounted on the lever 8 at a certain distance from its longitudinal axis is a pressure body 9, which is arranged to be pressed against the diaphragm 1. The spout 2 passes through a central hole in the pressure body 9. For the purpose of anchoring the spout 2 in the pressure body 9, it is terminated on the underside of the pressure body 9 with a cap 10 which is forced into the spout 2 and abuts the under surface of the pressure body 9 via a flared portion.

Upon continued movement of the lever, the pressure body 9 forces the diaphragm 1 into the pressure chamber 7, thereby to increase the pressure on the enclosed liquid. As a result hereof, the flange 4 will be urged still further against the outer surface of the groove 5, into complete sealing abutment therewith. The overpressure prevailing in the chamber 7 has only one exit path, namely through the spout 2, whereupon the wall 3 is pressed to one side and the slot 3' widened. The dispensed liquid is then able to pass out through the cap 10.

When the lever 8 is released, the diaphragm 1 springs back to its rest position. A low pressure now prevails in the pressure chamber 7, and the wall 3 is drawn by suction to a sealing position in the spout 2. In conjunction therewith, the flange 4 is drawn by suction away from its sealing abutment in the groove 5, thereby permitting liquid to enter from a storage vessel 11 located above the pump. When the pressure in the pressure chamber reaches approximately atmospheric pressure, the flange 4 sealingly abuts the outer surface of the groove 5, as a result of the pre-tensioning of the flange. These pre-tensioning forces overcome the hydrostatic pressure exerted by the liquid in the vessel.

Because the pressure in the pressure chamber 7 is not precisely atmospheric pressure, the wall 3 is held sealingly against the inner wall of the spout 2 by the prevailing air pressure, thereby preventing liquid from passing through the slot 3'. As a result of the slight S-shape of the spout 2, the sealing pressure between the wall 3 and the inner wall of the spout is amplified. The upper wall 6 of the pressure chamber 7 is located in a recess in the bottom of the storage vessel 11, where it supports against strips 12 which hold the same in place in a manner to leave a circumferentially extending annular slot 11'. The wall 6 is supported from beneath by the diaphragm 1, via its flange 4. The pump as a whole is held in position beneath the storage vessel 11 by a bracket structure 13 having an inwardly directed flange abutting the peripheral undersurface of the diaphragm 1. The bracket structure 13 is screwed to the under surface of the storage vessel by means of screws 14.

I claim:

1. A lever-operated diaphragm pump for fluid dispensing apparatus mounted beneath a fluid-storage vessel in fluid communication therewith, said diaphragm pump comprising:

a lever;

a resilient cup-shaped diaphragm having a cavity and including a discharge spout which is formed integrally with the diaphragm, said discharge spout having a fluid passage extending from said cavity and including an obliquely positioned resilient wall which is firmly connected along the greater part of its periphery with said discharge spout;

a plate element made of a nonresilient material having a bottom surface and rigidly disposed above said cavity, said bottom surface and said cavity together forming a pressure chamber, said plate element having at its bottom surface an annular groove which is in fluid communication with said fluid-storage vessel;

a cylindrical flange provided on that side of said cup-shaped diaphragm which is remote from said discharge spout;

said cylindrical flange having a rim of such dimension which in use needs to be biased in order to be accommodated during assembly along a part of its height within said annular groove arranged in said plate element, whereby upon operation of said lever, said cup-shaped diaphragm is urged to move towards said plate element, thereby increasing fluid pressure in said pressure chamber, in use, to disperse a quantity of said fluid from said pressure chamber through said discharge spout by dilating said obliquely positioned resilient wall.

2. The diaphragm pump according to claim 1, wherein said discharge spout has a center line which is slightly S-shaped, so that said discharge spout has a free end which is displaced laterally towards the side, on which said obliquely positioned resilient wall is lowest and not connected with said inner wall of the spout.

3. The diaphragm pump according to claim 2, wherein said lever is provided with means to apply pressure against said cup-shaped diaphragm.

4. The diaphragm pump according to claim 2, wherein said plate element is concave on the side thereof facing said pressure chamber.

5. The diaphragm pump according to claim 2, wherein said annular groove has a substantially tapering cross section which diverges towards said pressure chamber.

6. The diaphragm pump according to claim 2, wherein said fluid storage vessel is provided with strips which restrict any vertical upward movement of said plate element, and wherein said cup-shaped diaphragm is held urged against said fluid storage vessel by means of a flange structure attached to said fluid storage vessel by means of screw fastenings.

7. The diaphragm pump according to claim 1, wherein said cylindrical flange is of such dimension that it needs to be compressed, when assembling said pump, to a diameter smaller than the diameter of said cylindrical flange in a fully relaxed state.

8. The diaphragm pump according to claim 7, wherein said lever is provided with a pressure applying body which presses against said cup-shaped diaphragm.

9. The diaphragm pump according to claim 7, wherein said plate element is concave on the side thereof facing said pressure chamber.

10. The diaphragm pump according to claim 7, wherein said annular groove has a substantially tapering cross section which diverges towards said pressure chamber.

11. The diaphragm pump according to claim 7, wherein said fluid storage vessel is provided with strips which restrict any vertical upward movement of said plate element, and wherein said cup-shaped diaphragm is held urged against said fluid storage vessel by means of a flange structure attached to said fluid storage vessel by means of screw fastenings.

12. The diaphragm pump according to claim 1, wherein said lever includes means to apply pressure against said cup-shaped diaphragm.

13. The diaphragm pump according to claim 12, wherein said discharge spout includes a cap and extends through said pressure applying means and is terminated with said cap.

14. The diaphragm pump according to claim 13, wherein said plate element is concave on the side thereof facing said pressure chamber.

15. The diaphragm pump according to claim 12, wherein said plate element is concave on the side thereof facing said pressure chamber.

16. The diaphragm pump according to claim 12, wherein said annular groove has a substantially tapering cross section which diverges towards said pressure chamber.

17. The diaphragm pump according to claim 12, wherein said fluid storage vessel is provided with strips which restrict any vertical upward movement of said plate element, and wherein said cup-shaped diaphragm is held urged against said fluid storage vessel by means of a flange structure attached to said fluid storage vessel by means of screw fastenings.

18. The diaphragm pump according to claim 1, wherein said plate element is concave on the side thereof facing said pressure chamber.

19. The diaphragm pump according to claim 1, wherein said annular groove has a substantially tapered cross section which diverges towards said pressure chamber.

20. The diaphragm pump according to claim 1, wherein said fluid storage vessel includes reinforcing rib-like strips which restrict any vertical upward movement of said plate element, and wherein said pump includes a flange structure attached to said fluid storage vessel by means of screw fastenings.

* * * * *